US012689888B2

(12) United States Patent
Nitsch et al.

(10) Patent No.: US 12,689,888 B2
(45) Date of Patent: Jul. 21, 2026

(54) FLEXIBLE REMOTE SIM PROVISIONING

(71) Applicant: GIESECKE+DEVRIENT MOBILE SECURITY GERMANY GMBH, Munich (DE)

(72) Inventors: Nils Nitsch, Markt Schwaben (DE); Harry Li, Stockholm (SE); Tommy Thorstensson, Bromma (SE); Dan Thorén, Taby (SE); Markus Haubner, Altomunster (DE); Andreas Kitzmann, Munich (DE)

(73) Assignee: GIESECKE+DEVRIENT MOBILE SECURITY GERMANY GMBH, Munich (DE)

( * ) Notice: Subject to any disclaimer, the term of this patent is extended or adjusted under 35 U.S.C. 154(b) by 266 days.

(21) Appl. No.: 18/571,664

(22) PCT Filed: Jun. 30, 2022

(86) PCT No.: PCT/EP2022/025299
§ 371 (c)(1),
(2) Date: Dec. 18, 2023

(87) PCT Pub. No.: WO2023/274582
PCT Pub. Date: Jan. 5, 2023

(65) Prior Publication Data

US 2024/0365106 A1 Oct. 31, 2024

(30) Foreign Application Priority Data

Jul. 1, 2021 (DE) ..... 10 2021 003 392.2

(51) Int. Cl.
*H04W 8/20* (2009.01)
*H04W 4/50* (2018.01)
(Continued)

(52) U.S. Cl.
CPC ..... *H04W 8/20* (2013.01)

(58) Field of Classification Search
None
See application file for complete search history.

(56) References Cited

U.S. PATENT DOCUMENTS 9,439,076 B2 9/2016 Rudolph
9,930,520 B2 * 3/2018 Park ..... H04W 12/04
(Continued)

FOREIGN PATENT DOCUMENTS

DE 102015001815 A1 8/2016
DE 102019001840 B3 4/2020
(Continued)

OTHER PUBLICATIONS

International Search Report from corresponding PCT Application No. PCT/EP2022/025299, Oct. 27, 2022.
(Continued)

*Primary Examiner* — Tuan A Tran
(74) *Attorney, Agent, or Firm* — Workman Nydegger

(57) ABSTRACT

A method, at a data generation server, for generation of a profile image for downloading the profile image from the profile server to an eUICC hosted in a device, is provided for the purpose of installing a profile corresponding to the profile image in the eUICC. The method includes the steps: Ga) provide, on the data generation server, at least one global identifier and at least a first functionality identifier and a second functionality identifier different from the first functionality identifier; Gb) generate, on the data generation server, at least a first profile image and a second profile image; Gc) assign the at least first and second profile images to the same global identifier; Gd) store the at least first and second profile image as profile images assigned to the same
(Continued)

| User | GI | FI=FI1 | FI=FI2 |
|---|---|---|---|
| U1 | GI = GI1 = [ICCID=123456 Ki = abcde] | P = P1(U1) | P = P2(U1) |
| U2 | GI = GI2 = [ICCID = 789012 Ki = fghij] | P = P1(U2) | P = P2(U2) |
| U3 | GI = GI3 = [ICCID = 345678 Ki = klmno] | P = P1(U3) | --- |

global identifier, for providing the first and second profile image to the profile server for download to eUICCs.

15 Claims, 1 Drawing Sheet

(51) Int. Cl.

| | |
|---|---|
| ***H04W 8/18*** | (2009.01) |
| ***H04W 12/00*** | (2021.01) |
| ***H04W 12/06*** | (2021.01) |

(56) References Cited

U.S. PATENT DOCUMENTS

| | | | | |
|---|---|---|---|---|
| 10,129,736 | B2 * | 11/2018 | Park | H04W 12/04 |
| 10,187,784 | B1 | 1/2019 | Chen et al. | |
| 10,334,428 | B1 * | 6/2019 | Chen | H04W 8/205 |
| 10,484,861 | B2 * | 11/2019 | Wozniak | H04W 4/50 |
| 10,516,988 | B2 * | 12/2019 | Fan | H04B 1/3816 |
| 10,531,285 | B2 * | 1/2020 | Jung | H04W 8/265 |
| 10,609,022 | B2 * | 3/2020 | Park | H04W 12/06 |
| 10,768,918 | B2 * | 9/2020 | Gao | H04W 12/35 |
| 10,848,961 | B1 * | 11/2020 | Larsson | H04W 8/08 |
| 10,986,487 | B2 * | 4/2021 | Park | H04W 12/02 |
| 10,999,273 | B2 * | 5/2021 | Park | H04W 12/068 |
| 11,057,827 | B1 * | 7/2021 | Dreiling | H04W 8/04 |
| 11,516,676 | B1 * | 11/2022 | Holmes | H04W 12/72 |
| 11,516,732 | B2 * | 11/2022 | Dreiling | H04W 48/16 |
| 2019/0174299 | A1 | 6/2019 | Ullah et al. | |
| 2019/0208405 | A1 | 7/2019 | Park et al. | |
| 2020/0120494 | A1 * | 4/2020 | Fares | H04W 12/35 |
| 2020/0374686 | A1 | 11/2020 | Zhang et al. | |
| 2021/0105609 | A1 | 4/2021 | Park et al. | |
| 2022/0150686 | A1 | 5/2022 | Nitsch | |

FOREIGN PATENT DOCUMENTS

| | | | |
|---|---|---|---|
| EP | 2802162 | A1 | 11/2014 |
| EP | 2910039 | B1 | 12/2019 |
| EP | 3582526 | A1 | 12/2019 |
| EP | 3716656 | A1 | 9/2020 |
| WO | 2019120609 | A1 | 6/2019 |
| WO | 2020187450 | A1 | 9/2020 |

OTHER PUBLICATIONS

German Search Report from corresponding DE Application No. 102021003392.2, Mar. 16, 2022.

* cited by examiner

| User | GI | FI=FI1 | FI=FI2 |
|---|---|---|---|
| U1 | GI = GI1 = [ICCID=123456 Ki = abcde] | P = P1(U1) | P = P2(U1) |
| U2 | GI = GI2 = [ICCID = 789012 Ki = fghij] | P = P1(U2) | P = P2(U2) |
| U3 | GI = GI3 = [ICCID = 345678 Ki = klmno] | P = P1(U3) | --- |

FLEXIBLE REMOTE SIM PROVISIONING

FIELD OF THE INVENTION

The present invention relates to Remote SIM Provisioning, that is provisioning of profiles for subscriber identity Modules, or briefly SIMs, from a remote server to an eUICC, such as according to the GSMA specification SGP.22 or SGP.02.

BACKGROUND OF THE INVENTION

The GSMA specification [1] SGP.22 RSP Technical Specification Version 2.2.2 5 Jun. 2020 (or briefly SGP.22), particularly chapter 3.1 called "Remote Provisioning" describes Remote SIM Provisioning by downloading of Profiles to an embedded Universal Integrated Circuit Card, eUICC, hosted in a device. The device is understood to be a mobile device or mobile terminal, i.e. a device or terminal having the ability to communicate in a mobile network, i.e. a wireless network. According to chapter 3.1.1 "Profile Download Initiation", upon order by an End-User at a Mobile Network Operator (Operator, MNO), a ready-made profile already stored at the profile provisioning server SM-DP+ is reserved. After that, according to chapter 3.1.2 "Common Mutual Authentication Procedure", a mutual authentication procedure between the profile provisioning server SM-DP+ and the eUICC is performed. After that, according to chapter 3.1.3 "Profile Download and Installation", the reserved profile is downloaded to the eUICC, via the device, and installed in the eUICC. In the SGP.22 setup, the profile provisioning server is called SM-DP+.

Devices according to SGP.22 are particularly so-called consumer devices such as Smartphones, Smartwatches and Tablet PCs with mobile network connectivity, and other computers with mobile network connectivity.

Document [1] SGP.22 chapter 2.4 "eUICC Architecture", particularly FIG. 3, describes the architecture of an eUICC. Each profile is contained in an individual ISD-P, its Issuer Security Domain Profile. Each ISD-P contains one profile. The profile has the primary technological service task of authenticating the eUICC or/and its device or/and its End-User to the mobile network to which the profile is associated. The ISD-P or the profile can contain additional elements like applets and applications. The applets and applications can have service purposes going beyond authentication to the mobile network, for example payment services or ticketing services. Particularly, Near Field Communication, NFC, payment services can be implemented by an NFC payment applet or application in a profile or ISD-P. Currently, also the applets and applications offered for download to an ISD-P are static and ready-made. Profiles (or generally contents) to be downloaded to the eUICC on the occasion of a Remote SIM Provisioning session as described in [1] SGP.22 chapter 3.1.3 "Profile Download and Installation" are downloaded to the eUICC in form of a Bound Profile Package BPP, which is described in greater detail in [1] SGP.22 chapter 2.5.4, and in GSMA specification [3] SGP.21, RSP Architecture, Version 2.2, 1 Sep. 2017. The Bound Profile Package contains a sequence of Tag Length Value, TLV, commands for installation of, in this order (1) an ISD-P with Configuration of the ISD-P, (2) Meta Data, (3) Profile Protection Keys, (4) the payload of the actual profile in form of the Protected Profile Package, all in the eUICC.

The GSMA specification [2] SGP.02, Remote Provisioning Architecture for Embedded UICC Technical Specification Version 4.1 5 Jun. 2020 has the aim to define a technical solution for the remote provisioning and management of the Embedded UICC (eUICC) in machine-to-machine devices, also referred to as M2M devices. Also, according to [2] SGP.02, download and installation of a profile from a profile server comprises steps of ISD-P creation, key establishment, and download and installation of the profile.

The profile data of a profile comprise several individual data unique for every profile, for example the International Mobile Subscriber Identity IMSI, the authentication key Ki, and the profile number International Circuit Card IDentifier, ICCID.

Other data are specific for a type of eUICC or device, for example the eUICC-ID or chip-hardware-number Equipment IDentifier, EID, (hardware identifier as identified in [2] SGP.02), or parts of EID such as a country indicator, or the International Mobile Equipment Identity IMEI (mobile equipment=device=mobile terminal), or parts of the IMEI such as the Type Allocation Code TAC indicating a type of device.

Currently, eUICCs and devices are partly standardized and universal, and partly proprietary and individual. Particularly, different eUICCs and different devices have different capabilities. For this reason, ready-made profiles, applets and applications are generally not fully compatible with a target eUICC or/and device—i.e. the eUICC or/and device for which the profile, applet, application is destined—from the beginning. Instead, adaptations to the ready-made profiles, applets and applications are required, once the eUICC type and device type or/and the individual target eUICC and individual target device are known. Currently, such adaptations are often done subsequently to the download, by commands sent to the eUICC after download and installation of the profile or applet or application. The adaptions thus cause additional traffic on the mobile network, additional provisioning time, and possibly additional monetary costs.

Documents [4] EP 2 910 039 B1 and [5] EP 2 802 162 A1 from the prior art disclose each a solution seeking to reduce the download traffic from a profile server to a eUICC by providing a profile template in a device or eUICC, so only a partial profile has to be downloaded from the profile server when a new profile is desired.

Document [6] DE102015001815A1 from the prior art proposes to generate local copies of profiles in a eUICC and further use the copies as templates for new profiles, also reducing the download traffic from the profile server required for a new profile.

The above cited documents from the prior art require a profile or template to be present on the eUICC already, so as to enable download and implementation of a new profile with reduced mobile network traffic between the profile server and the set of devices and eUICC.

Document [7] US2020/0374686A1 from the prior art discloses an embedded universal integrated circuit card (eUICC) profile management method, for handling two profiles, and comprising: obtaining first metadata of a first profile of the eUICC, sending a profile obtaining request to a profile server, wherein the profile obtaining request comprises an eUICC identifier, a profile identifier, and the operating system update flag; receiving a second profile from the profile server; installing the second profile in the eUICC; and configuring second metadata of the second profile based on the first metadata.

Document [8] EP3716656A1 from the prior art discloses a profile generation and acquisition method. If a first subscriber identity module card in a terminal device has been registered with a first service provider, when a user needs to subscribe to a second service provider, the second service provider server acquires from a first service provider server service registration information used by the first subscriber identity module card to access a first service provider network. The second service provider server generates a second profile for accessing a second service provider network based on the service registration information. The second profile may be generated based on existing service registration information.

Document [9] DE102019001840B3 from the prior art discloses a method for providing subscription profiles to a subscriber identity module eUICC, by means of a subscription server. The subscription server has knowledge of a first subscription profile installed in the subscriber identity module. The first subscription profile has a first profile file structure and has first profile data stored in the first profile file structure. At least part of a second profile file structure of a second subscription profile is marked in the subscription server. The second subscription profile is sent to the subscriber identity module, wherein the marked part of the second subscription profile is sent without second profile data. The missing profile data can be taken over from the first subscription profile already present in the eUICC.

Document [10] DE102015001815A1 from the prior art discloses a subscriber identity module eUICC set up for generating a second profile using a file structure of a first profile installed in the subscriber identity module already as a template. A cloning function of the eUICC makes a copy of the profile file structure of the first subscription profile and saves it as a second profile file structure in the subscriber identity module, so that a second profile file structure is generated that is set up to receive second profile data.

Document [11] US2019/0208405A1 from the prior art discloses an electronic device including an eUICC in which a first profile is installed. The eUICC requests a second profile to be installed in the eUICC from a first server based on the first profile, receives the second profile from a second server associated with the first server, and installs the received second profile in the eUICC. The second profile and the first profile include the same subscriber identification information, for example the same telephone number MSISDN.

Document [12] US2021/0105609A1 from the prior art discloses a method for enabling further usage of a profile contained in a non-removable eUICC hosted in a terminal, when swapping from said terminal to a different terminal. Herein, the profile is removed from the terminal and stored to an interim storage, e.g. a cloud server, and later transferred to the different terminal. An activation code may be generated upon removing the profile, and be used to download a profile.

Document [13] US2019/0174299A1 from the prior art discloses a method enabling migration of a subscription from a source device to a destination device. The method comprises: receiving, from the source device, a confirmation of a first profile associated with the subscription having been deleted in the source device, and securing a second profile associated with the subscription to be provisioned onto the eUICC of the destination device. At least one piece of subscription information is the same for the first and second profiles. An activation code for use in migration of the subscription to the destination device is used.

Document [14] US10187784B1 from the prior art discloses systems and methods for transferring SIM profiles between eUICC devices.

Objective of the Invention

It is an object of the present invention to provide a flexible, adaptable and at the same time reliable profile generation and download method for generating and downloading a profile to an eUICC hosted in a device. Advantageously, by the presented solution, the overall amount or/and volume of required communications between the profile server and the eUICC upon profile download and installation shall be reduced so as to reduce time and/or costs and/or risk of failure due to communication interrupts.

Also, it would be desirous to be able to decide only late, on the provisioning stage, exactly what the device or/and eUICC requires depending on the device/eUICC capabilities and adapt the profile in such a way to build a perfect fit package for the device.

SUMMARY OF THE INVENTION

In greater detail, the object of the invention is achieved by an embedded system with the following features, according to any one of the independent claims. Embodiments of the invention are presented in dependent claims.

The invention provides for a method, at a data generation server, for generation of a profile image for downloading the profile image from a profile server to an eUICC hosted in a device, for the purpose of installing a profile corresponding to the profile image in the eUICC.

The method comprising the steps:

Ga) provide, on the data generation server, at least one global identifier and at least a first functionality identifier and a second functionality identifier different from the first functionality identifier;

Gb) generate, on the data generation server, at least a first profile image and a second profile image, the first profile image based on the global identifier and the first functionality identifier, and the second profile image based on the global identifier and the second functionality identifier;

Gc) assign the at least first and second profile images to the same global identifier;

Gd) store the at least first and second profile image as profile images assigned to the same global identifier, for providing the at least first and second profile image to the profile server for download to eUICCs.

According to some embodiments of the invention, step Gb) is performed as either one of the following:

Gb1) generate each of the at least first and second profile images separately;

OR

Gb2) (Gb2-1) generate a universal profile image based on at least two, namely at least the first and the second, functionality identifiers; (Gb2-2) and subsequently extract from the universal profile image, at least, the first functionality identifier to generate the first profile image, and the second functionality identifier to generate the second profile image;

OR

Gb3) (Gb3-1) generate an unspecific profile image based on no functionality identifier; (Gb3-2) and subsequently provide on the data generation server, separately from the unspecific profile, at least two, namely at least the first and the second, functionality identifiers; (Gb3-3) and subsequently generate, at least: from the unspecific profile image and the separately provided first functionality identifier the first profile image; and from the unspecific profile image and the separately provided second functionality identifier the second profile image.

According to some embodiments of the invention, the at least one functionality identifiers is or are provided to the data generation server, in either one of the following ways:

G1) in combination with a profile generation order provided from a mobile network operator MNO server to the data generation server;

OR

G2) independently from a profile generation order.

A data generation server according to the present invention is implementing means for executing a method as described above.

The data generation server particularly comprises:

Ga) means implemented to provide, on the data generation server, at least one global identifier and at least a first functionality identifier and a second functionality identifier different from the first functionality identifier;

Gb) means implemented to generate, on the data generation server, at least a first profile image and a second profile image, the first profile image based on the global identifier and the first functionality identifier, and the second profile image based on the global identifier and the second functionality identifier;

Gc) means implemented to assign the at least first and second profile images to the same global identifier;

Gd) means implemented to store the at least first and second profile image as profile images assigned to the same global identifier, for providing the at least first and second profile image to the profile server for download to eUICCs.

A method for providing a profile image for downloading from a profile server to an eUICC hosted in a device, for the purpose of installing a profile corresponding to the profile image in the eUICC, comprising the steps:

a) on the profile server, receive from a data generation server, at least two different profile images of the same profile, wherein the at least two profile images comprise each at least one same global identifier and at least one differing functionality identifier;

b) at the profile server, receive—from the device or from the eUICC or from a different server or from a different device or from a different eUICC—a request to download a profile to the eUICC, the request including at least one functionality requirement indicator and at least one global identifier;

c) at the profile server, select a profile image having a functionality identifier matching with the received functionality requirement indicator and provide it for download to the eUICC.

According to some embodiments of the invention, the method comprises in step c): at the profile server, detect that either the request lacks a functionality identifier, or the request contains a functionality identifier for which no profile image is provided, and in reaction select a predefined default profile image and provide it for download to the eUICC.

According to some embodiments of the invention, the method comprises the further step: f) download the selected image to the eUICC, and, from the downloaded profile image, install the profile in the eUICC.

According to some embodiments of the invention, the method further comprises the step: from the profile image, prepare a profile package, and provide for download, and/or download, the profile image to the eUICC in form of the profile package.

According to some embodiments of the invention, the above-mentioned profile package comprises meta data, wherein the functionality indicator is contained, or also contained, in the meta data.

A profile server according to the present invention implements means for performing a method as described above.

The profile server particularly comprises:

a) means implemented to receive, from the data generation server, at least two different profile images of the same profile, wherein the at least two profile images comprise each at least one same global identifier and at least one differing functionality identifier;

b) means implemented to receive—from the device or from the eUICC or from a different server or from a different device or from a different eUICC—a request to download a profile to the eUICC, the request including at least one functionality requirement indicator and at least one global identifier;

c) means implemented to select a profile image having a functionality identifier matching with the received functionality requirement indicator and to provide the selected profile image for download to the eUICC.

A system comprises a data generation server and a profile server.

The at least one same global identifier can for example be either one or several of, or a part thereof:

international mobile subscriber identity IMSI;

authentication key Ki;

profile number ICCID.

The at least one different functionality identifier can for example be either one or several of, or a part thereof:

chip hardware identifier EID of the eUICC;

international mobile equipment identifier IMEI of the device;

type allocation code TAC of the device;

identifier of network technology being either one of the group including following network technologies: 2G technology, 3G technology, 4G technology, 5G technology, GSM, UMTS, CMDA, LTE;

a device capability indicator according to GSMA SGP.22;

a UICC capability indicator according to GSMA SGP.22.

The following list is the device capabilities defined by GSMA within SGP.22. The functionality identifier can be or comprise any one or several of the device capability identifiers listed in the following.

DeviceCapabilities::=SEQUENCE;
gsmSupportedRelease VersionType OPTIONAL,
utranSupportedRelease VersionType OPTIONAL,
cdma2000onexSupportedRelease VersionType OPTIONAL,
cdma2000hrpdSupportedRelease VersionType OPTIONAL,
cdma2000ehrpdSupportedRelease VersionType OPTIONAL,
eutranEpcSupportedRelease VersionType OPTIONAL,
contactlessSupportedRelease VersionType OPTIONAL,
rspCrlSupportedVersion VersionType OPTIONAL,
nrEpcSupportedRelease VersionType OPTIONAL,
nr5gcSupportedRelease VersionType OPTIONAL,
eutran5gcSupportedRelease VersionType OPTIONAL.

The functionality identifier can be or comprise any one or several of the UICC capabilities defined within the SGP.22 specification under section Annex H ASN.1 Definitions (Normative)—Definition of UICCCapability.

Each profile image of the same profile preferably represents a different variant of the same profile, wherein different variants differ from each other by the at least one functionality corresponding to the at least one differing functionality identifier.

For example, two profile images having different EIDs with each including a country identifier for a different country correspond to profile variants for corresponding different countries.

According to some embodiments of the invention, each profile image of the same profile, including at least the first profile image and the second profile image, is assigned to the same profile number ICCID.

The data generation server and the profile server are, according to some embodiments:

either a SGP.02 SM-DP server and SGP.02 SM-SR server or a similar server infrastructure;

or a SGP.22 SM-DP+ or a similar server infrastructure.

In the above-described invention, the functionality requirement indicator and the global identifier are used to decide which profile image to generate and/or download. In addition, a profile server configuration of the profile server from which the profile image is downloaded to the eUICC also takes influence on profile generation and/or on selection of a profile image for download. With the profile server configuration, control can be executed on the choice of which profile image is to be downloaded. What is downloaded can be different depending on how profile server indicators are configured. The configurations to control the indicators of the profile server configuration are controllable on the profile type level. It is also possible to via API/UI change the configuration of the indicators. Therefore, after such a change of indicators, profile image versions can be generated and downloaded, the generation and download of which wasn't possible before the change.

BRIEF DESCRIPTION OF THE DRAWINGS

Embodiments of the invention will now be described with reference to the accompanying drawings, throughout which like parts are referred to by like references, and in which represents.

DETAILED DESCRIPTION OF THE INVENTION

Figures 1, 2:
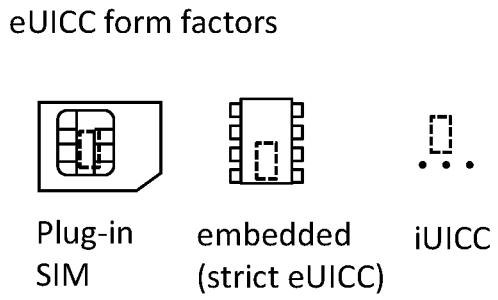
FIG. 1 a schedule representing for each of three users up to two different profile images.
FIG. 2 different form factors or eUICCs.

FIG. 1 shows a schedule representing, for each of three users, identifiers of up to two different profile images on a data generation server. The schedule shows three identifiers U1, U2, U3 of three users of mobile devices registered at a data generation server. Each of the three users U1, U2, U3 is assigned a set of global identifiers GI unique for the respective user. In the example of FIG. 1, a unique set of global identifiers GI comprises a profile number ICCID and an Authentication Key Ki. The first user with identifier U1 is assigned a global identifier set GI having value GI1 and comprising the profile number ICCID with value 123456 and authentication key Ki with value abcde. The second user with identifier U2 is assigned a global identifier set GI having value GI2 and comprising the profile number ICCID with value 789012 and authentication key Ki with value fghij. The third user with identifier U3 is assigned a global identifier set GI having value GI3 and comprising the profile number ICCID with value 345678 and authentication key Ki with value klmno. The shown values of identifiers are merely symbolic and in a real product would have a format compliant with the applicable standards, for example by GSMA and/or ETSI.

For the first user, with identifier U1, a first profile image P1(U1) and a second profile image P2(U1) are generated on the data generation server, and both are assigned to the same profile number ICCID having value 123456, and the same authentication key Ki having value abcde. Alternatively, the two profiles are assigned only the same profile number ICCID having value 123456, and different authentication keys Ki. The first profile image P1(U1) and the second profile image P2(U1) differ by a different functionality identifier FI, which has for the first profile image P1(U1) a value FI=FI1, and for the second profile image P2(U1) a value FI=FI2. The different functionality identifiers FI can for example represent different mobile devices with different features, or with different operating systems, or the like, or different eUICCs with different features, or combinations of such differences. Also, there can be more than the two shown functionality identifiers FI1 and FI2, i.e. FI3, FI4, etc.

Similarly, for the second user, to whom is assigned a user identifier U2, two profiles P1(U2) and P2(U2) are generated on the data generation server, and assigned to the same profile number ICCID having value 789012 and same authentication key Ki having value fghij (or the two profiles are assigned only the same profile number ICCID=789012, and different authentication keys Ki). The first profile image P1(U2) and the second profile image P2(U2) differ by a different functionality identifier FI, which has for the first profile image P1(U2) a value FI=FI1, and for the second profile image P2(U2) a value FI=FI2.

For a third user, only one profile image having a global identifier set GI=GI3 with profile number ICCID=345678 and authentication key Ki=klmno is present on the data generation server so far, and further profile images with the same global identifier set GI=GI3 can be generated later.

The set of global identifiers of FIG. 1 must comprise at least one global identifier GI, however, can comprise two, three, four, . . . or more global identifiers as well. Alternatively, to the example of FIG. 1, for example, only the profile number ICCID could be provided as the global identifier GI.

FIG. 2 shows different form factors of eUICCs, namely, from left to right, a plug-in SIM card, an embedded UICC or eUICC in a stricter sense, and an integrated UICC or iUICC integrated into a chipset of a mobile device.

The present invention is generally not dependent on the form factor of the eUICC and is applicable to eUICCs having any of the eUICC form factors shown in FIG. 2, or still a different form factor.

The mobile device hosting the eUICC can have different form factors as well, for example smartphone, smartwatch, tablet-PC, automotive M2M device.

What is claimed is:

1. A method, at a data generation server, for generation of a profile image for downloading the profile image from a profile server to an eUICC hosted in a device, for the purpose of installing a profile corresponding to the profile image in the eUICC, the method comprising the steps:

Ga) provide, on the data generation server, at least one global identifier and at least a first functionality identifier and a second functionality identifier different from the first functionality identifier, wherein the first functionality identifier and the second functionality identifier each identify one or more respective functionalities;

Gb) generate, on the data generation server, at least a first profile image and a second profile image, the first profile image based on the global identifier and the first functionality identifier, and the second profile image based on the global identifier and the second functionality identifier;

Gc) assign the at least first and second profile images to the same global identifier;

Gd) store the at least first and second profile image as profile images assigned to the same global identifier, for providing the at least first and second profile image to the profile server for download to eUICCs.

2. The method according to claim 1, wherein step Gb) is performed as either one of the following:

Gb1) generate each of the at least first and second profile images separately; or Gb2) (Gb2-1) generate a universal profile image based on at least two, namely at least the first and the second, functionality identifiers; (Gb2-2) and subsequently extract from the universal profile image, at least, the first functionality identifier to generate the first profile image, and the second functionality identifier to generate the second profile image; or Gb3) (Gb3-1) generate an unspecific profile image based on no functionality identifier; (Gb3-2) and subsequently provide on the data generation server, separately from the unspecific profile, at least two, namely at least the first and the second, functionality identifiers; (Gb3-3) and subsequently generate, at least: from the unspecific profile image and the separately provided first functionality identifier the first profile image; and from the unspecific profile image and the separately provided second functionality identifier the second profile image.

3. The method according to claim 1, wherein the at least one functionality identifiers is or are provided to the data generation server, in either one of the following ways:

G1) in combination with a profile generation order provided from a mobile network operator MNO server to the data generation server; or G2) independently from a profile generation order.

4. The method or data generation server or profile server according to claim 1, wherein the at least one same global identifier is either one or several of, or a part thereof:

international mobile subscriber identity IMSI;

authentication key Ki;

profile number ICCID.

5. The method or data generation server or profile server according to claim 1, wherein the at least one different functionality identifier is either one or several of, or a part thereof:

chip hardware identifier EID of the eUICC;

international mobile equipment identifier IMEI of the device;

type allocation code TAC of the device;

identifier of network technology being either one of the group including following network technologies: 2G technology, 3G technology, 4G technology, 5G technology, GSM, UMTS, CMDA, LTE;

a device capability indicator according to GSMA SGP.22;

a UICC capability indicator according to GSMA SGP.22.

6. The method or data generation server or profile server according to claim 1, wherein each profile image of the same profile represents a different variant of the same profile, wherein different variants differ from each other by the at least one functionality corresponding to the at least one differing functionality identifier.

7. The method or data generation server or profile server according to claim 1, wherein each profile image of the same profile, including at least the first profile image and the second profile image, is assigned to the same profile number ICCID.

8. The method or data generation server or profile server according to claim 1, wherein the data generation server and the profile server are:

either a SGP.02 SM-DP server and SGP.02 SM-SR server or a similar server infrastructure; or a SGP.22 SM-DP+ or a similar server infrastructure.

9. A data generation server implementing means for executing a method according to claim 1, the data generation server particularly comprising:

Ga) means implemented to provide, on the data generation server, at least one global identifier and at least a first functionality identifier and a second functionality identifier different from the first functionality identifier;

Gb) means implemented to generate, on the data generation server, at least a first profile image and a second profile image, the first profile image based on the global identifier and the first functionality identifier, and the second profile image based on the global identifier and the second functionality identifier;

Gc) means implemented to assign the at least first and second profile images to the same global identifier;

Gd) means implemented to store the at least first and second profile image as profile images assigned to the same global identifier, for providing the at least first and second profile image to the profile server for download to eUICCs.

10. A method for providing a profile image for downloading from a profile server to an eUICC hosted in a device, for the purpose of installing a profile corresponding to the profile image in the eUICC, the method comprising the steps:

a) on the profile server, receive from a data generation server, at least two different profile images of the same profile, wherein the at least two profile images comprise each at least one same global identifier and at least one differing functionality identifier, wherein each functionality identifier identifies one or more respective functionalities;

b) at the profile server, receive—from the device or from the eUICC or from a different server or from a different device or from a different eUICC—a request to download a profile to the eUICC, the request including at least one functionality requirement indicator and at least one global identifier;

c) at the profile server, select a profile image having a functionality identifier matching with the received functionality requirement indicator and provide it for download to the eUICC.

11. The method according to claim 10, comprising in step c): at the profile server, detect that either the request lacks a functionality identifier, or the request contains a functionality identifier for which no profile image is provided, and in reaction select a predefined default profile image and provide it for download to the eUICC.

12. The method according to claim 10, further comprising the step: from the profile image, prepare a profile package, and provide for download, and/or download, the profile image to the eUICC in form of the profile package.

13. The method according to claim 12, wherein the profile package comprises meta data, and wherein the functionality indicator is contained, or also contained, in the meta data.

14. A profile server implementing means for performing a method according to claim 10, the profile server particularly comprising:

a) means implemented to receive, from the data generation server, at least two different profile images of the same profile, wherein the at least two profile images comprise each at least one same global identifier and at least one differing functionality identifier;

b) means implemented to receive—from the device or from the eUICC or from a different server or from a different device or from a different eUICC—a request to download a profile to the eUICC, the request including at least one functionality requirement indicator and at least one global identifier;

c) means implemented to select a profile image having a functionality identifier matching with the received functionality requirement indicator and to provide the selected profile image for download to the eUICC.

15. A system comprising a data generation server according to claim 9 and a profile server implementing a method for providing a profile image for downloading from a profile server to an eUICC hosted in a device, for the purpose of installing a profile corresponding to the profile image in the eUICC, the method comprising the steps:

a) on the profile server, receive from a data generation server, at least two different profile images of the same profile, wherein the at least two profile images comprise each at least one same global identifier and at least one differing functionality identifier;

b) at the profile server, receive—from the device or from the eUICC or from a different server or from a different device or from a different eUICC—a request to download a profile to the eUICC, the request including at least one functionality requirement indicator and at least one global identifier;

c) at the profile server, select a profile image having a functionality identifier matching with the received functionality requirement indicator and provide it for download to the eUICC;

the profile server further comprising:

a) means implemented to receive, from the data generation server, at least two different profile images of the same profile, wherein the at least two profile images comprise each at least one same global identifier and at least one differing functionality identifier;

b) means implemented to receive—from the device or from the eUICC or from a different server or from a different device or from a different eUICC—a request to download a profile to the eUICC, the request including at least one functionality requirement indicator and at least one global identifier;

c) means implemented to select a profile image having a functionality identifier matching with the received functionality requirement indicator and to provide the selected profile image for download to the eUICC.

* * * * *